United States Patent [19]

Krasberg

[11] 4,153,001

[45] May 8, 1979

[54] MANNED SUBMARINE

[76] Inventor: Alan R. Krasberg, 24 Devanha Gardens, Aberdeen, Scotland, ABI 2UU

[21] Appl. No.: 784,835

[22] Filed: Apr. 5, 1977

[51] Int. Cl.[2] ..... B63G 8/00

[52] U.S. Cl. ..... 114/312; 405/185; 114/314; 114/335; 114/342

[58] Field of Search ..... 114/16 R, 16.4, 16.6, 114/16.8, 50, 51, 16 C, 52–54, 312, 314, 335, 342; 61/69 R, 69 A, 107, 111, 110, 72.4–72.7; 166/0.5, 0.6; 244/137 R

[56] References Cited

U.S. PATENT DOCUMENTS

| | | | |
|---|---|---|---|
| 1,079,500 | 11/1913 | Lesourd | 114/54 |
| 1,180,861 | 4/1916 | Macklind | 114/16 R |
| 1,331,014 | 2/1920 | Kawinski | 114/50 |
| 1,350,225 | 8/1920 | Hay | 114/16 C |
| 1,814,689 | 7/1931 | Grieshaber | 114/16.8 |
| 1,822,435 | 9/1931 | Facchin | 61/69 A |
| 2,602,300 | 7/1952 | Collins | 61/72.4 |
| 2,965,060 | 12/1960 | Asano | 114/16 R |
| 3,292,564 | 12/1966 | Lehmann | 114/16 R |
| 3,561,387 | 2/1971 | Kumm et al. | 114/16 R |
| 3,608,321 | 9/1971 | Richardson et al. | 61/72.3 |
| 3,911,786 | 10/1975 | Scheetz | 244/137 R X |

FOREIGN PATENT DOCUMENTS

| | | | |
|---|---|---|---|
| 500279 | 12/1919 | France | 114/51 |
| 972016 | 1/1951 | France | 114/51 |

*Primary Examiner*—Trygve M. Blix

*Assistant Examiner*—Sherman D. Basinger

*Attorney, Agent, or Firm*—Burns, Doane, Swecker & Mathis

[57] ABSTRACT

A manned submarine includes first and second side-by-side chambers extending in a fore-to-aft direction. The first chamber is maintained at substantially atmospheric pressure and includes sleeping and eating compartments for ship-based personnel, and a galley. The second chamber is maintained at greater than atmospheric pressure and includes sleeping and eating compartments for diver personnel. Passages interconnect the chambers, enabling ship-based personnel from the first chamber to service diver personnel in the second chamber. The submarine carries guides which can be mated with corresponding guides on a piece of underwater equipment to stabilize the submarine against lateral movement and allow the equipment to be attached to the submarine for transport. The submarine carries weights which are placed on the water bed and connected to the submarine by initially slackened lines. When the submarine lifts an object the lines become taut and the weights act as a restraining force to prevent the submarine from losing control. The submarine carries aligned guide collars for guiding pipes. A pair of winches are mounted on the submarine for screwing pipes together in end-to-end fashion and extending the pipes outwardly from the submarine. An object such as a diving bell can be carried at the outer end of the pipeline so as to be extendable into locations of limited accessibility, or potential danger to the submarine.

15 Claims, 8 Drawing Figures

MANNED SUBMARINE

BACKGROUND AND OBJECTS

This invention pertains to manned submarines.

The growing importance of offshore activities, especially those connected with the exploration for and recovery of crude oil and gas, has increased the need for reliable underwater craft for housing men and equipment involved in underwater activities. Proposals have heretofore been made involving manned submarines. Exemplary of such proposals are the disclosures of U.S. patent No. 1,814,689 issued to Fieshaber on July 14, 1931; U.S. Pat. No. 3,292,564 issued to Lehman on Dec. 20, 1966; U.S. Pat. No. 3,613,615 issued to Sturm et al on Oct. 19, 1971; U.S. Pat. No. 3,688,720 issued to Lok on Sept. 5, 1972; and U.S. Pat. No. 3,713,411 issued to Bordessoule on Jan. 30, 1973.

Many commercial offshore activities require the attention of underwater personnel for numerous man-hours. At present these activities rely on a surface vessel or platform for support and hence are subject in varying degree to surface weather conditions. As an example, heavy construction in the North Sea at present is only possible for one or two days out of ten during the worst six months of the year, and most activities aside from those involving semi-submersible drilling rigs, simply stop during this period. Another factor is that overall efficiency in performance is somewhat lessened when personnel are repeatedly transported between the submerged work site and living quarters above the water surface. A large, autonomous heavily-powered underwater construction submarine would be an efficient and cost-effective way of avoiding these kinds of problems.

However, the long-term lift support requirement of diving personnel who are subjected to repeated and prolonged exposure to alien conditions, presents considerable physical problems and renders it difficult for divers to live in submarines.

In addition, the present day utilization of submarines for performing heavy-duty underwater activities leaves much room for improvement, especially in areas such as the transporting of large heavy equipment like pipe alignment frames and welding habitats, the ability to make heavy lifts with adequate control, and the supply of power and heavy duty tools for divers. Many submarines are not able to effectively and safely perform functions such as these, necessitating the expense and efforts of additional machines and man power.

Another problem connected with underwater activities involves the requirement of divers to perform repairs or inspections in or around structures which are not accessible to the divers' life support equipment. In this connection, underwater activities in severe environments, such as deep frigid waters, requires the use of special diving suits which are supplied via umbilical conduits with breathing gas, communications, and a heating medium for the diver, and a diver's life-line. Such equipment can be carried within a diving bell that is suspended from a surface vessel, with umbilical conduits being about 75 to 100 feet in length. Frequently, however, underwater activities within structures like offshore drilling platforms cannot be effectively performed with such equipment. That is, a diving bell cannot be suspended within the open-trussed support jacket which carries the platform. Such jackets are often hundreds of feet across, so that even if a diving bell is positioned adjacent the jacket exterior, the normal extent of the umbilical conduits is not sufficient to provide an effective range of maneuverability for the divers.

It is, therefore, an object of the present invention to provide novel methods and apparatus for obviating or minimizing problems of the sort previously discussed.

It is another object of the invention to provide a novel manned submarine vessel.

It is a further object of the present invention to provide novel methods and apparatus for improving the underwater versatility of manned submarines.

It is another object of the invention to provide a novel submarine which effectively accommodates diver and non-diver personnel for prolonged periods of habitation.

It is a further object of the invention to provide a novel manned submarine vessel which is capable of lifting large, heavy loads in a controlled manner.

It is an additional object of the invention to provide novel methods and apparatus for enabling a manned submarine to carry out and observe underwater explosions.

It is a further object of the invention to provide novel methods and apparatus for increasing the safe maneuvering range of divers within structures of limited accessibility.

BRIEF SUMMARY OF A PREFERRED EMBODIMENT OF THE INVENTION

In accomplishing the intended objects, a preferred form of submarine includes first and second side-by-side chambers extending in a fore-to-aft direction. The first chamber is maintained at substantially atmospheric pressure and includes sleeping and eating compartments for ship-based personnel, and a galley. The second chamber is maintained at greater than atmospheric pressure and includes sleeping and eating compartments for diver personnel. Passages interconnect the chambers, enabling ship-based personnel from the first chamber to service diver personnel in the second chamber and to allow transfer of personnel and equipment back and forth. In this manner, ship-based personnel and diver personnel can exist under environmental conditions more closely suited to their individual needs.

The submarine carries guides which can be mated with corresponding guides on a piece of underwater equipment to stabilize the submarine against lateral movement and allow the equipment to be attached to the submarine for transport. To lift an object from the water bottom, a buoyant lift member, such as a submarine, is provided. Either the lift member or the object, or both is connected to an anchoring device by a slackened connection. As the buoyancy of the lift member is increased and lifts the object, the connection becomes taut and restrains the lift member. This limits the height of the lift and prevents the lift member from going out of control.

The submarine carries aligned guide collars for guiding pipes. A pair of winches are mounted on the submarine for screwing pipes together in end-to-end fashion and extending the pipes outwardly from the submarine. An object such as a driving bell can be carried at the outer end of the pipeline so as to be extendable into locations of limited accessibility.

THE DRAWINGS

A preferred embodiment of the invention is described subsequently in detail in connection with the accompanying drawings in which like numerals designate like elements and in which.

Figure 4A:
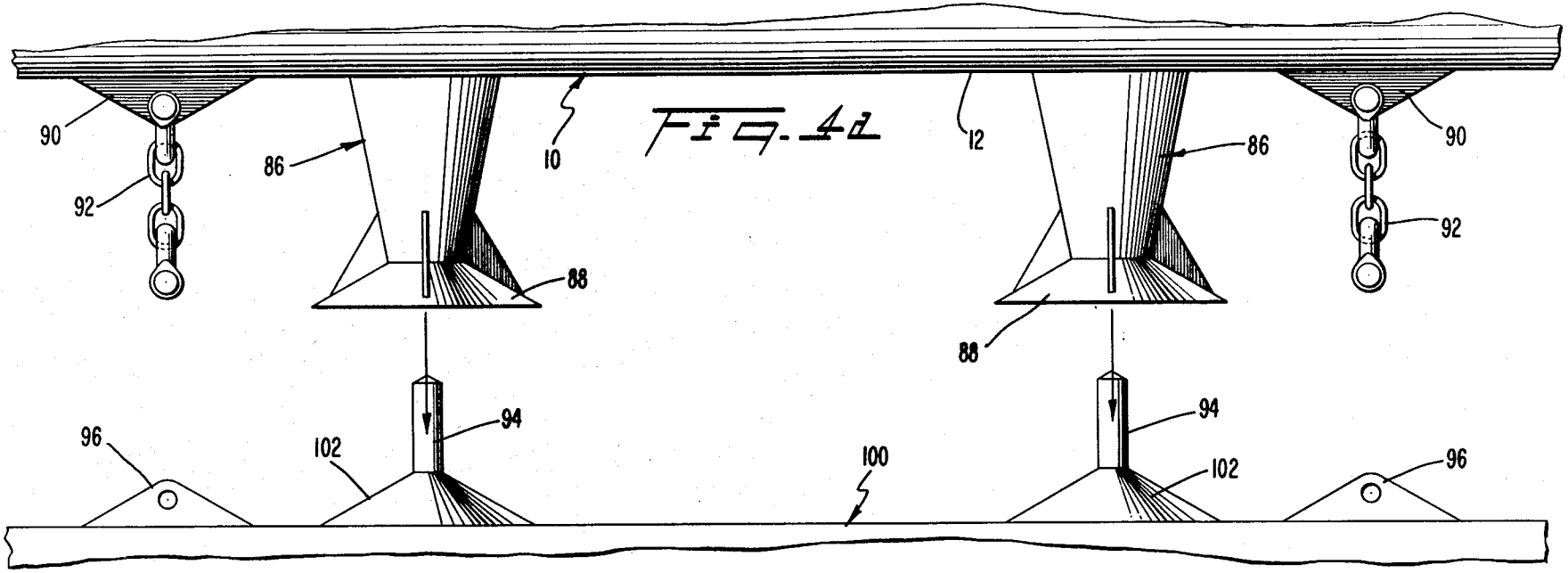
Figure 4B:
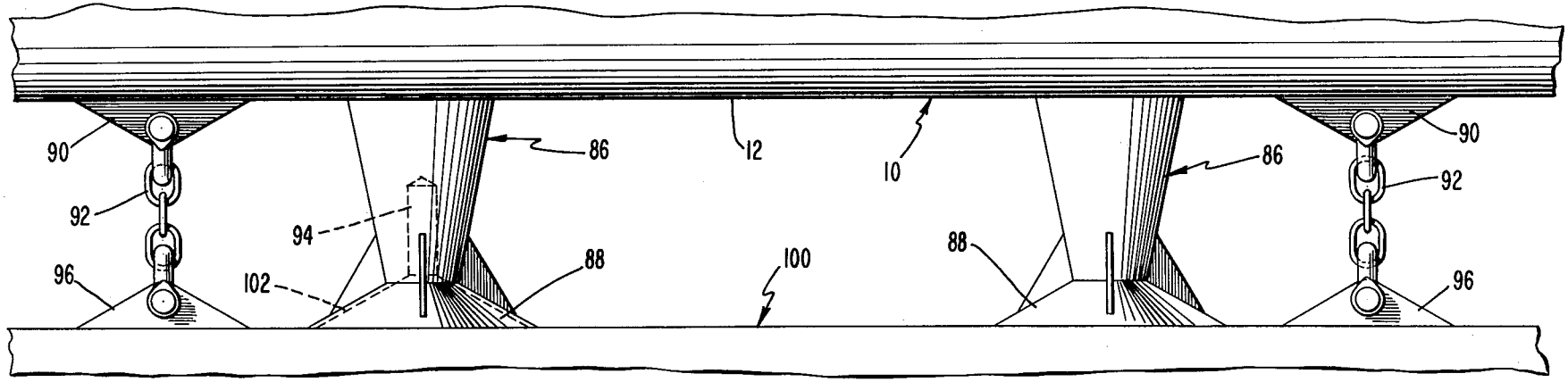
Figures 5, 6, 7:
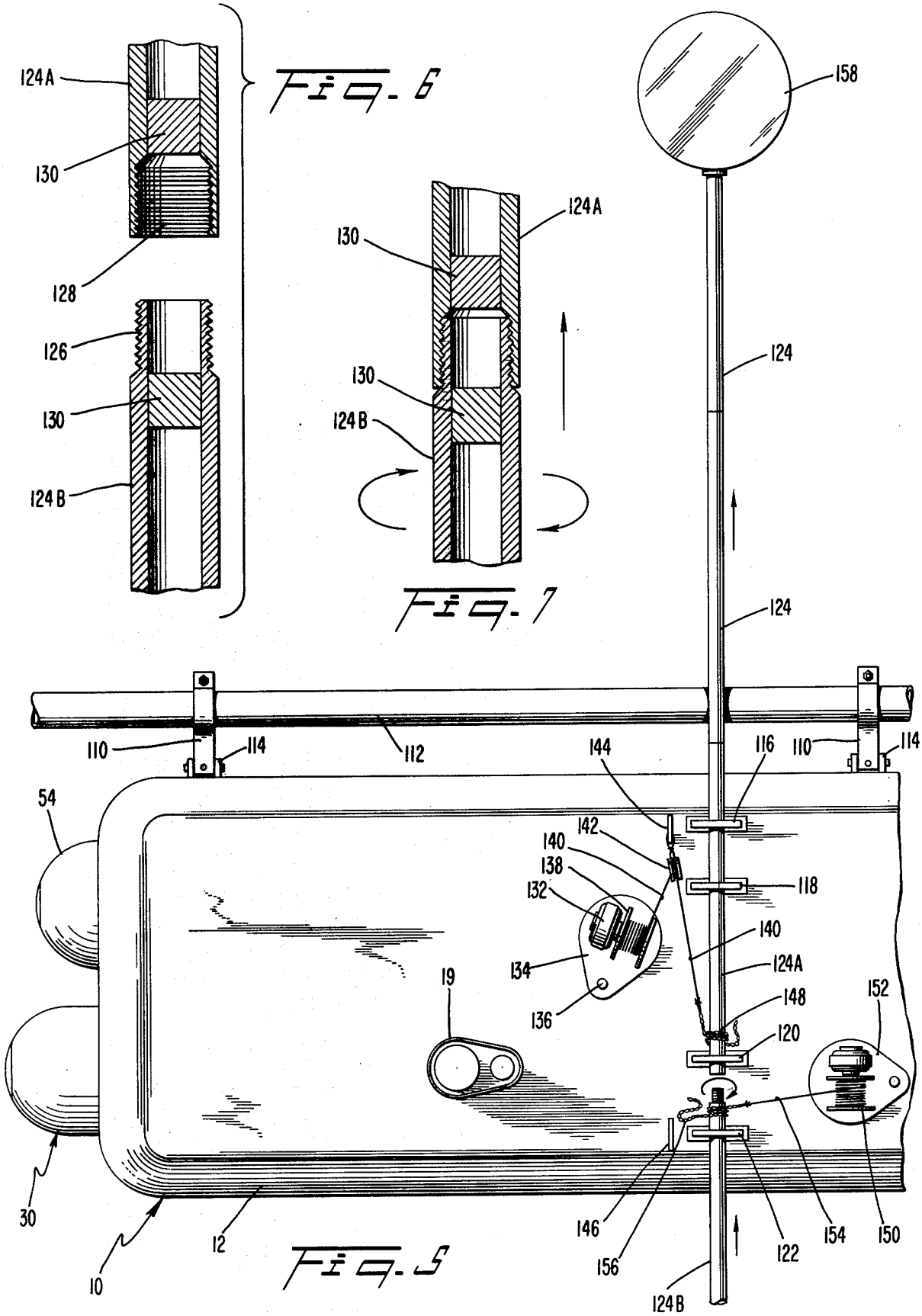

FIG. 4*a* is a close-up view of an uncoupled connection between the submarine and welding habitat;

FIG. 4*b* is a close-up view of the connection of FIG. 4*a* in a coupled condition;

FIG. 5 is a plan view of the submarine adapted for extending a diving bell outwardly;

FIG. 6 is a longitudinal sectional view of pipes being connected during the process of extending the diving bell; and FIG. 7 is a view similar to FIG. 6 showing the pipes in connected condition.

DETAILED DESCRIPTION OF A PREFERRED EMBODIMENT OF THE INVENTION

Figure 1:
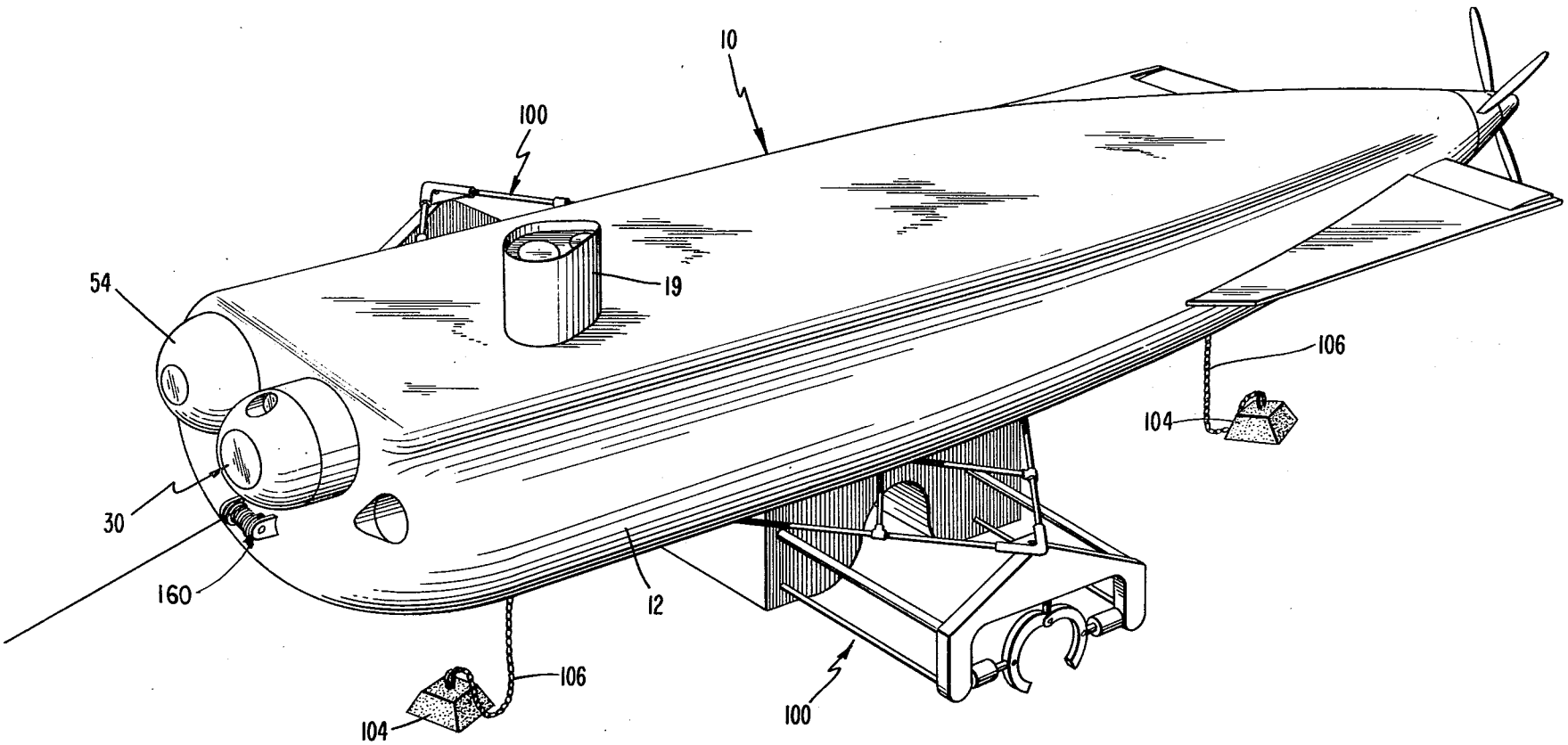
FIG. 1 is a perspective view of a submarine according to the present invention, carrying a pipeline alignment frame and welding habitat, and showing lift limiting weights deployed.
Figure 2:
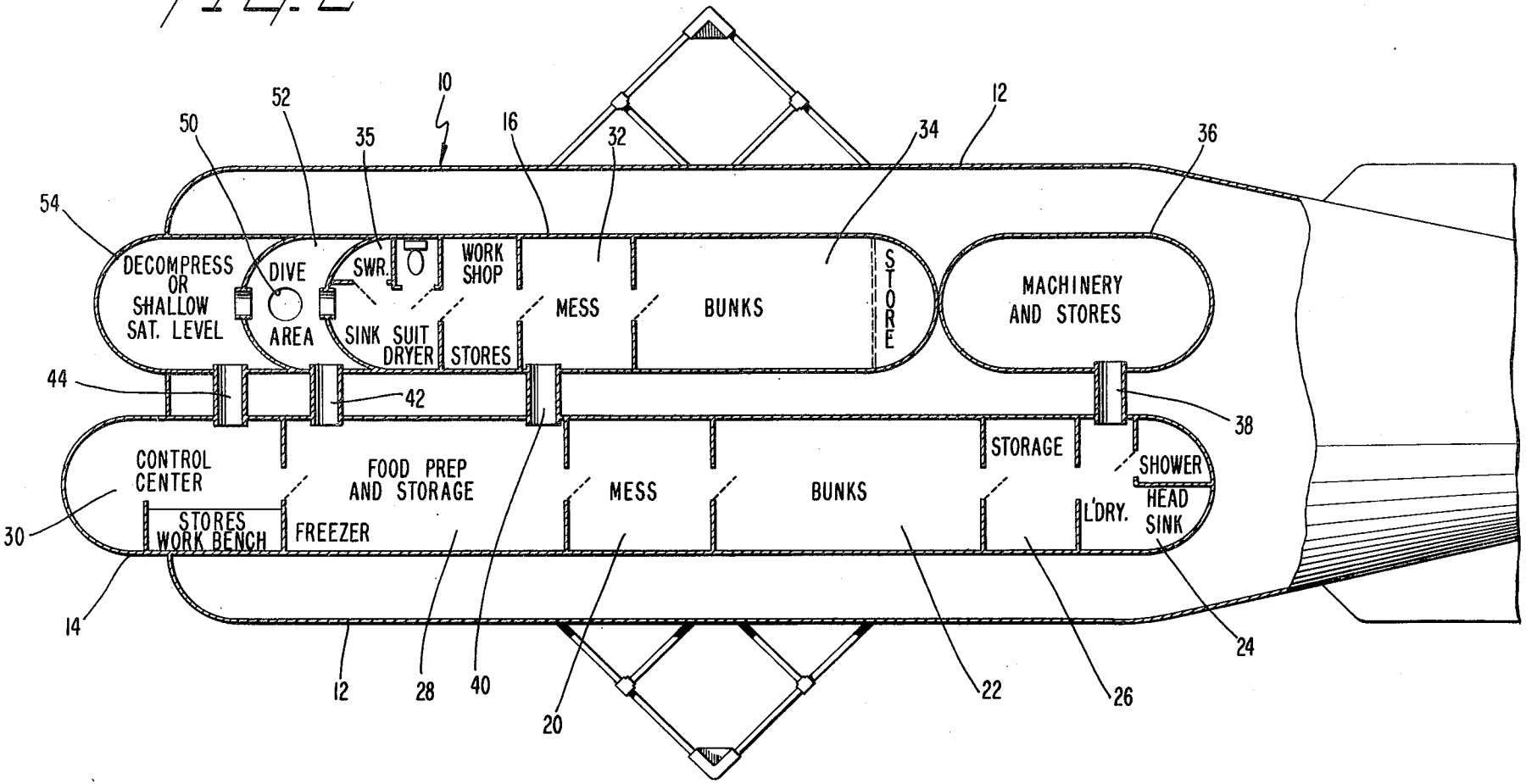
FIG. 2 is a schematic plan view of the submarine with the outer hull broken away to expose internal chambers of the submarine.
Figure 3:
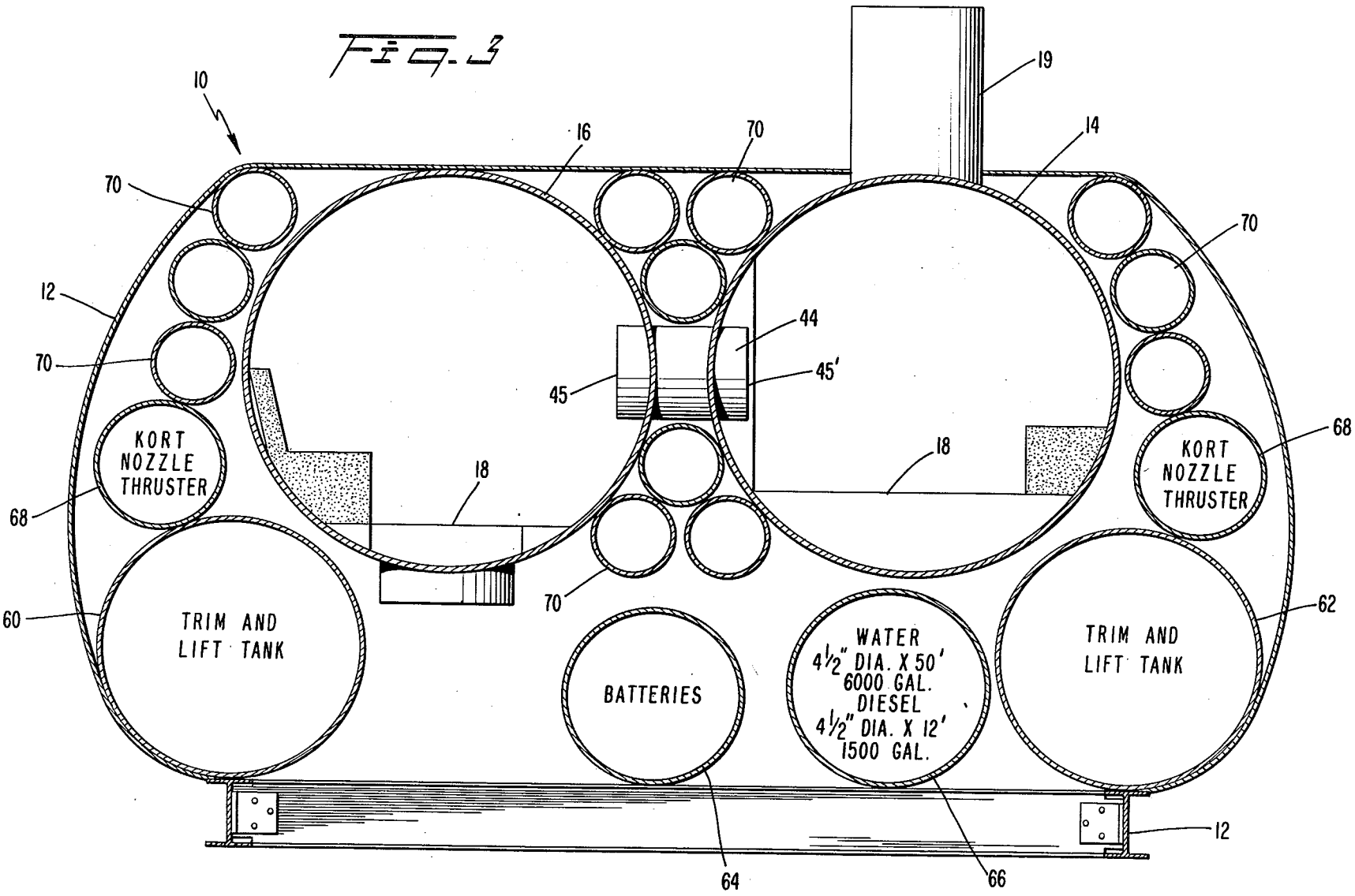
FIG. 3 is a schematic cross-sectional view of the submarine.

A submarine 10 according to the present invention is depicted in FIG. 1. The submarine has an outer steel shell or hull 12 of generally rectangular cross-sectional configuration (FIG. 3). Housed within the hull are a pair of side-by-side cylindrical chambers or vessels 14, 16. These parallel chambers extend in fore-to-aft directions.

The chambers 14, 16 each comprise a plurality of tubular segments that are welded in longitudinal alignment and are secured to the hull by suitable rigid bracing welded therebetween.

Disposed across a bottom portion of each chamber 14,16 is horizontal flooring 18. The flooring 18 is spaced sufficiently from the top of the chambers to provide therebetween ample headroom to accommodate personnel.

Access to the chamber 14 is provided by a passageway 19 through the top of the hull.

The chambers 14,16 are each divided into separate compartments, enabling the chambers to function as independent habitats. That is, the chamber 14 comprises a mess compartment 20, a sleeping or bunk compartment 22, a lavatory and shower compartment 24, a storage area 26, a galley 28, and a control center 30.

The chamber 16 comprises a mess compartment 32, a sleeping compartment 34, and a lavatory and shower compartment 35.

The living environments within the side-by-side chambers 14,16 are separately controlled by air temperature and pressure control equipment of any suitable conventional type. This equipment is housed in a main machinery chamber 36 which houses additional energy generating machinery for the submarine. This chamber 36 is disposed in alignment with the chamber 16 and communicates with the chamber 14 via a passage 38.

The environmental control system can be of any suitable type having the necessary ducting to the various compartments, with the requirement that the chambers 14,16 are supplied and controlled separately so that environmental conditions, especially gas composition, pressure and temperature are independently controlled in these chambers.

In this fashion, the chamber 16 can be set at conditions which are optimum for diver personnel who perform underwater tasks, i.e., pressure can be maintained near that of outside conditions. As a result, diver personnel can work externally of the submarine and then perform normal on-board activities such as eating, sleeping, recreation, etc., within the chamber 16 which is maintained at a storage pressure chosen to maximize the effectiveness of the divers; minimizing decompression time to reenter the living quarters, and maximize diver vertical work range or time on bottom.

The chamber 14 is occupied by ship-based personnel whose primary duties are ship-based, such as those involved in the operation and maintenance of the submarine, cooking, etc. Conditions within this chamber 14 are maintained at near normal atmospheric settings. Consequently, control and running of the submarine would take place in the control center 30 located at the fore-end of the atmospheric chamber 14. Food is stored in the atmospheric chamber 14 and prepared in the galley compartment 28. Prepared food is served to ship-based personnel in the mess 20 of the atmospheric chamber, and to diver personnel in the mess 32 of the pressurized chamber 16. A lock 40 is provided between the gally 28 and the mess 32 in the pressurized chamber 16 to accommodate this service. Additional hatches or locks 42,44 are provided between the chambers in areas where transfer of equipment or personnel is desirable. The locks 40,42,44 each include hatches 45,45' at each end. One hatch 45 may be opened to enable an article to be placed in the lock, and then closed. Thereafter, the other hatch 45' is opened to enable the article to be removed under equalized pressure conditions. Transfer between the chambers 14,16 can thereby be effected in safety. One or more of the locks can be sized to accommodate personnel for transfer between chambers. Before the submarine descends, pressure in the pressure chamber 16 is progressively increased in accordance with the expected outside pressure. When the submarine reaches the work site, diver personnel will be sufficiently pressurized to begin work activity. For example, activities at a certain anticipated depth, pressures on the order of 700–800 psi can be maintained in the pressurized chamber 16, while pressures in the atmospheric chamber 14 are maintained near standard atmospheric pressures of 14.7 psi. When work has been completed, which could take as long as six weeks or more, the submarine surfaces, and the pressure chamber 16 is progressively decompressed so that the divers approach atmospheric pressure conditions.

The divers have access to the sea from the chamber 16 through a hatch 50 which opens downwardly from a dive compartment 52 in the pressurized chamber 16.

A special decompression compartment 54 is provided in the pressurized chamber 16 for maintaining pressures different from that of the pressure chamber 16. This need can arise to handle bounce dive decompressions or saturation decompression. In addition, where activity at a job site extends over a substantial vertical range some divers may be stored in compartment S4 at a different level than those in the main body of chamber 16 in order to effectively cover the whole depth range. Divers from the decompression compartment 54 may be provided with a separate exit-entry hatch or may utilize the dive hatch 50. In this connection, the pressure within the dive compartment 52 can be controlled in the usual manner to accommodate divers from either area.

The lock 44 between the decompression compartment 54 and the control center 30 accommodates the transfer of personnel to the atmospheric chamber 14 following decompression, or the transfer of personnel to the pressure chamber for pressurization. Alternatively, such transfer can be effected through the lock 42.

The submarine includes trim and lift tanks 60,62 at opposite sides of the hull. Suitable mechanism is provided for selectively ballasting and deballasting these tanks 60,62 in a conventional manner.

A battery storage container 64 is provided, as well as water and diesel fuel receptacles 66.

Nozzle thrusters 68 are situated between the chambers 14,16 and the hull 12. High pressure gas cylinders 70 are provided for storage of air, helium, oxygen and other gases.

The submarine is adapted to perform various useful underwater activities. For example, the underside of the submarine hull 12 is provided with downwardly opening guide cones or sockets 86 having frusto-conical lower rims 88 (FIG. 4). Also provided are eyelets 90 for the attachment of chains 92.

The sockets 86 and eyelets 90 are connected in any suitable pattern on the hull 12 which corresponds to an arrangement of upwardly projecting guide pins 94 and eyelets 96 of a piece of underwater equipment such as a pipeline alignment frame and welding habitat 100, for example.

By positioning the submarine within the water above the welding habitat 100, the pins 94 and sockets 86 can be brought into vertical alignment, so that the submarine and equipment can be docked together and then joined by the chains. The flared configuration of the rims 88 facilitates the merging of the submarine and welding habitat together. The pins 94 extend upwardly from frusto-conical holders 102 which are flared in complimentary fashion to the rims 88. When docking is effected, engagement between the surfaces of the holders 102 and the rims 88 resists relative lateral movement between the submarine and welding habitat. With the submarine stabilized in this fashion, the chains 92 are connected between the eyelets 90,96 to couple the submarine and welding habitat together. Subsequently, the welding habitat is lifted by the submarine and transported to an underwater work site.

The present invention also contemplates a method for lifting large objects in a controlled manner. In this connection, the submarine must be made sufficiently buoyant to lift the object. Once the object leaves the water bed there may be a tendency for the object and the submarine to accelerate upwardly at too rapid a pace, presenting the risk that the submarine may go out of control. This risk is most evident in cases where considerable buoyancy is initially required to break the mud suction being applied to the object.

To minimize this risk, the submarine carries a plurality of weights 104, or other suitable anchoring devices. The weights can be placed on the water bed and connected to the submarine by means of flexible lines, such as chains 106. Initially, as the submarine is being connected to the object, the chains are in a slackened condition. When the submarine and object rise, however, the chains 106 approach a taut condition. Once the chains become taut, the weights apply downward forces to the submarine to act as a brake or restraint. Thereafter, the weights are returned to submarine and the submarine, with its load, proceeds to a transfer point.

Another advantageous feature of the submarine 10 is the provision thereon of mechanism for increasing the range within which divers can maneuver. As noted earlier, diving bells cannot be suspended within structures, such as offshore platform jackets that exhibit limited accessibility. Consequently, the range of travel of divers is significantly restricted.

In accordance with the submarine of the present invention, however, a diving bell can be supported from the submarine 10 and then extended to a position within the jacket. With reference to FIGS. 5–7, the submarine 10 is anchored by clamps 110 to a horizontal strut 112 of an offshore jacket. The clamps 110 can be fastened to suitable brackets 114 on the side of the submarine hull 12 provided for such purpose. These brackets permit limited relative movement between the submarine and jacket in response to current effects during installation, but then are clamped firmly thereafter. A plurality of collars 116, 118,120,122 are mounted atop the submarine hull and are aligned in a direction transverse to the fore-to-aft submarine axis. These collars 116–122 are adapted to slidably receive and clamp sections of pipe 124. The pipes can be of any suitable type, but preferably comprise hollow steel piping having external threading 126 at one end and internal threading 128 at the other. In this manner, the pipes 124 can be connected in end-to-end fashion. The pipes 124 are preferably provided with plugs 130 at both ends so that the buoyancy thus created very nearly balances the weight of the pipe. This makes it easy to handle the pipes underwater and reduces the bending moment.

Mounted atop the submarine 10 is a powered shifting winch 132 carried on a stand 134 which is swingably mounted by means of a vertical pivot 136, enabling the winch 132 to be rigged in different positions. The shifting winch 132 includes a cable drum 138 whose cable 140 passes around a sheave 142 secured to one of two eyelets 144,146 situated at opposite edges of the submarine 10. The end of the cable is attached to a short piece of chain 148 which can be wrapped around a pipe 124.

A powered screwing winch 150 is mounted on a stand 152 for swiveling movement on the other side of the axis formed by the collars and has its cable 154 attached to a short piece of chain 156 that can be wrapped around a pipe 124.

In practice, a diving bell 158 of conventional design is attached to the end of one pipe 124 and is then extended from the submarine into the interior of the jacket by the sequential addition of pipes 124 in end-to-end fashion. That is, a first pipe 124A is positioned within the collars 116–120 and clamped, and a second pipe 124B is positioned within the collar 122, whereupon the threaded pipe ends are brought together. The short length of chain 156 secured to the screwing winch 150 is then spirally wrapped around the second pipe 124B and the screwing winch is then rotated to take-in cable. As the chain unwinds from the second pipe 124B it rotates the latter, thereby threadedly joining the pipes together. Pipe 124B is then unclamped.

The chain 148 of the shifting winch 132 is then wrapped tightly around the first pipe 124A and the shifting winch 132 is rotated to take-in cable. This causes the pipes 124A, 124B to be slid longitudinally through the collars 116–122. These steps are repeated until the diving bell 158 has been sufficiently extended.

To retract the diving bell, the sheave 124 is transferred to the other eyelet 148, the shifting winch is swung about its pivot 136, and the cable 140 is passed around the sheave 124. Then, the procedure for extending the diving bell is reversed. That is, the chain 156 is driven to unscrew the second pipe 124B from the first pipe 124A. Then the chain 148 is secured to the first pipe adjacent the collar 118 to pull the first pipe 124A through the collars so that a subsequent unscrewing operation can be performed.

In lieu of employing a winch 150 atop the submarine for screwing and unscrewing operations, a winch 160 mounted at the front of the submarine (FIG. 1) can be utilized for this purpose.

Pipes can be provided in any suitable fashion, as by being lowered from a surface vessel, or stored on the submarine.

In the event that the diving bell becomes stuck, it is merely necessary for the divers to follow the pipes 124 back to the submarine. Significantly, this travel, being horizontal, involves no decompression problems as would occur if vertical travel of the divers was required.

By virtue of the above-described technique, a compartment containing a breathable atmosphere and life support equipment can be disposed at a given location spaced from the submarine. Such technique can be utilized at a work site having remotely spaced work areas to avoid moving the submarine back and forth therebetween. The technique is also useful from a safety standpoint in allowing the submarine to lie out of the range of a hazardous operation, such as shutting down a subsea wellhead where fire and explosives at the water surface are producing falling wreckage. As noted earlier, the technique can also be employed to penetrate areas where a submarine or other diving systems cannot penetrate.

BRIEF SUMMARY OF MAJOR ADVANTAGES

It will be appreciated that a submarine according to the present invention facilitates the performance of underwater activities. Since there are provided separate chambers whose pressure conditions are set in accordance with the needs of ship-based personnel and diver personnel, respectively, such personnel can cohabit underwater for prolonged periods.

Transfer of divers between the chambers takes place via the decompression compartment 54, where divers are brought to proper pressure conditions. The decompression compartment also serves to maintain pressures different from that of the remainder of the pressure chamber so that divers working at different levels can be simultaneously accommodated.

An effective and easily-actuable connection is provided for joining a submarine to a submerged object to enable the submarine to lift and transport the object.

Lifting of an object is performed in safety by use of the restraining weights which limit the height of the lift in preventing a loss of submarine control.

By providing a method and apparatus whereby a submarine can support and extend a diving bell, the utility of divers in areas of limited accessibility is increased, and the submarine is able to be remotely of hazardous operations.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a manned submarine of the type for housing divers at an underwater work-site, said submarine comprising:

a hull;

first and second parallel, side-by-side chambers extending fore-to-aft within said hull;

said first chamber including a first living area maintained at substantially atmospheric pressure and including sleeping and eating compartments for ship-based personnel, and a galley;

said second chamber maintained at greater than atmospheric pressure and including a second living area comprising sleeping and eating compartments for diver personnel; and passage means interconnecting said first and second chambers enabling ship-based personnel from said first chamber to service diver personnel in said second chamber;

one end of said second chamber comprising a decompression compartment which is separate from said second living area for maintaining pressures different from that of said second living area;

said second chamber including a dive compartment disposed intermediate said decompression compartment and said second living area, said dive compartment including a dive hatch to the exterior of the submarine, and separate passages connecting the dive compartment with said decompression compartment and said second living area.

2. A submarine according to claim 1 wherein said first chamber includes a control center for directing operations of the submarine.

3. A submarine according to claim 1 wherein said submarine includes guide means rigidly mounted to said hull and which mates therebelow with cooperating guide means on a piece of equipment when said submarine is lowered toward said equipment, to stabilize said submarine laterally with respect to said equipment; and lifting means for connecting said submarine and said equipment while in a mated condition, said lifting means arranged to transmit lifting forces from the submarine to the equipment allowing said submarine to lift and transport said equipment.

4. A submarine according to claim 3 wherein said guide means on said submarine comprises a plurality of downwardly open sockets which mate with upstanding pins on said equipment.

5. A submarine according to claim 4 wherein said connecting means comprises chains for connection with fixtures on said submarine and said equipment.

6. A submarine according to claim 1 wherein said hull includes a plurality aligned guide collars for slidably guiding pipes; a shifting winch mounted on said hull for being rigged selectively in first and second positions wherein a cable of said shifting winch is connected to said pipe to slide pipes through said collars in one direction and can be re-rigged to slide said pipe in the opposite direction; and a screwing winch mounted on said hull so that the cable thereof can rotate one pipe relative to another to screw threaded ends thereof together.

7. A submarine according to claim 6 wherein said shifting winch is mounted atop said hull on one side of an axis defined by said collars; fixtures being mounted adjacent opposite edges of said submarine to carry a sheave, so that when said shifting winch is rigged in said first position the cable thereof is wrapped around a sheave at a first edge of said submarine and is connected to a pipe adjacent the opposite edge of the submarine to advance the pipe toward said first edge.

8. A manned submarine for transporting equipment to underwater locations comprising:

a hull;

guide means rigidly mounted to said hull which mates therebelow with cooperating guide means rigidly mounted on said equipment when said submarine is lowered toward said equipment, to prevent movement of said submarine laterally with respect to said equipment, said guide means on said submarine comprising a plurality of downwardly open sockets, including frusto-conical rims on the lower ends thereof arranged with flared ends thereof directed downwardly, said guide means on said equipment comprising a plurality of frusto-conical holders and guide pins projecting upwardly from said holders, said holders arranged with flared ends thereof directed downwardly in complimentary relationship to said rims so that said holders are guided into said rims by said guide pins as said submarine and equipment are brought together, said holders engaging said rims to prevent lateral movement between said equipment and submarine, and a plurality of lifting chains for connecting said submarine and said equipment while said guide means thereof are in a mated state, said lifting chains extending vertically to transmit lifting forces from the submarine to the equipment, allowing said submarine to lift and transport said equipment, while relative lateral movement between said submarine and equipment is prevented by engagement between said holders and rims.

9. A manned submarine for supporting and extending pipe sections outwardly therefrom said submarine comprising a hull, guide collar means for slidably guiding pipes as they are sequentially secured together in end-to-end fashion; a shifting winch mounted on said hull wherein the cable thereof is rigged to a pipe to slide said pipe through said collar means in one direction and can be re-rigged to slide said pipe in the opposite direction; and a screwing winch mounted on said hull so that the cable thereof rotates one pipe relative to another to screw threaded ends thereof together.

10. A submarine according to claim 9 wherein said shifting winch is mounted atop said hull on one side of an axis defined by said guide collar means, fixtures being mounted adjacent opposite edges of said submarine to carry a sheave, so that when said shifting winch is positioned in said first position the cable thereof is wrapped around a sheave at a first edge of said submarine and is connected to said pipe adjacent the opposite edge of the submarine to advance the pipe toward said first edge.

11. A method of positioning a diving bell at an underwater location comprising the steps of:

anchoring a submarine;

connecting an elongate member to said diving bell while supporting said elongate member within collars mounted on said submarine;

connecting the cable of a screwing winch mounted on said submarine to a second elongate member, and operating said screwing winch for rotating said second elongate member relative to said first elongate member to threadedly secure an end thereof to an end of said first elongate member;

connecting the cable of a shifting winch to said first elongate member and operating said shifting winch to slide said first and second elongate members through said collars in a direction for extending said diving bell away from said submarine.

12. A method according to claim 11 wherein the last-named connecting step comprises wrapping the cable of said shifting winch to a sheave mounted on a fixture at an edge of said submarine toward which said elongate members are to be shifted.

13. A method according to claim 12 including the step of retracting said diving bell by re-rigging said shifting winch and wrapping the cable thereof around a sheave mounted on the opposite edge of said submarine; connecting the cable of said shifting winch to said second elongate member and operating said shifting winch to slide said second elongate member through said collars in a direction for shifting said diving bell toward said submarine; and attaching the cable of said screwing winch to unscrew said second elongate member from said first elongate member.

14. A method according to claim 11 including the step of plugging the ends of said pipes prior to immersion thereof to maximize the buoyancy of the pipes.

15. A method of positioning a diving bell containing a breathable atmosphere at an underwater location comprising the steps of:

connecting an elongate member to said diving bell and to the submarine.

extending said elongate member relative to the submarine in a substantially horizontally outward direction while supporting the elongate member from the submarine, to move the diving bell away from the submarine, connecting a subsequent elongate member to the first named elongate member while continuing to support the latter from the submarine, and extending said subsequent elongate member relative to the submarine in a substantially horizontally outward direction while supporting the subsequent elongate member from the submarine, to move the diving bell still further away from the submarine.

* * * * *